US012037718B1

(12) United States Patent
Kim et al.

(10) Patent No.: US 12,037,718 B1
(45) Date of Patent: Jul. 16, 2024

(54) ARTIFICIAL TURF PILE YARN HAVING ANTIBACTERIAL AND COOLING EFFECT

(71) Applicant: Bong Jin Kim, Incheon (KR)

(72) Inventors: Bong Jin Kim, Incheon (KR); Soo Hyoung Kim, Gyeongsangbuk-do (KR)

(73) Assignee: Bong Jin Kim, Incheon (KR)

( * ) Notice: Subject to any disclaimer, the term of this patent is extended or adjusted under 35 U.S.C. 154(b) by 0 days.

(21) Appl. No.: 18/244,372

(22) Filed: Sep. 11, 2023

(51) Int. Cl.

| | |
|---|---|
| ***D02G 3/44*** | (2006.01) |
| ***D02G 3/02*** | (2006.01) |
| ***D06M 11/51*** | (2006.01) |
| ***D06M 11/74*** | (2006.01) |
| ***D06M 11/83*** | (2006.01) |
| ***D06M 15/263*** | (2006.01) |
| ***D06M 15/643*** | (2006.01) |
| ***D06M 23/08*** | (2006.01) |
| ***E01C 13/08*** | (2006.01) |
| *D06M 101/20* | (2006.01) |

(52) U.S. Cl.
CPC ..... *D02G 3/449* (2013.01); *D02G 3/02* (2013.01); *D02G 3/445* (2013.01); *D06M 11/51* (2013.01); *D06M 11/74* (2013.01); *D06M 11/83* (2013.01); *D06M 15/263* (2013.01); *D06M 15/643* (2013.01); *D06M 23/08* (2013.01); *E01C 13/08* (2013.01); *D06M 2101/20* (2013.01); *D06M 2200/00* (2013.01); *D10B 2321/021* (2013.01); *D10B 2505/202* (2013.01)

(58) Field of Classification Search
None
See application file for complete search history.

(56) References Cited

U.S. PATENT DOCUMENTS

2006/0208390 A1* 9/2006 Charbonneaux ..... A61P 31/10 264/165
2012/0258811 A1* 10/2012 Tetrault ..... C08J 3/24 252/78.3
2020/0173099 A1* 6/2020 Nair ..... C09D 133/04

FOREIGN PATENT DOCUMENTS

KR 102055556 12/2019

OTHER PUBLICATIONS

MatWeb, "Overview of materials for Linear Low Density Polyethylene (LLDPE), Compounding Resin", accessed online Feb. 21, 2024 at www.matweb.com/search/datasheet_print.spx?matguid=d334ceaaaa0b4a75b18cc8a185e26dda (Year: 2024).*

(Continued)

*Primary Examiner* — Kim S. Horger
(74) *Attorney, Agent, or Firm* — IPLA P.A.

(57) ABSTRACT

An artificial turf constructed on a floor of a sports stadium and used as a substitute for natural turf, specifically, an antibacterial artificial turf pile yarn includes 80 to 90% by weight of polyolefin resin, 3 to 10% by weight of a silicon-based compound, and 3 to 10% by weight of an antibacterial powder, wherein the antibacterial powder is copper sulfide powder, and the antibacterial artificial turf pile yarn is coated to have a cooling function, and wherein a PCM (phase change material) powder is mixed with one or more powers of titanium, aluminum, and graphene powders as a cooling material powder and coated on an artificial turf pile yarn with viscosity to have a cooling effect together with an antibacterial effect for inhibiting bacterial growth.

15 Claims, 4 Drawing Sheets

(56) References Cited

OTHER PUBLICATIONS

Rolph et al., "Blocked isocyanates: from analytical and experimental considerations to non-polyurethane applications", 2016, vol. 7, p. 7351-7364. (Year: 2016).*
Ghannam et al., "Rheological Porperties of Poly(dimethylsiloxane)", 1998, Ind. Eng. Chem. Res., vol. 37, p. 1335-1340. (Year: 1998).*

* cited by examiner

FIG. 1

| Item | LLPD (wt%) | PDMS (wt%) | Copper sulfide powder (wt%) | Color masterbatch (wt%) | Maleic acid anhydride (wt%) |
|---|---|---|---|---|---|
| Example 1 | 83 | 7.5 | 7.5 | 1 | 1 |
| Example 2 | 85 | 3 | 10 | 1 | 1 |
| Example 3 | 85 | 10 | 3 | 1 | 1 |
| Comparative Example 1 | 75 | 3 | 20 | 1 | 1 |
| Comparative Example 2 | 75 | 20 | 3 | 1 | 1 |
| Comparative Example 3 | 90.5 | 0 | 7.5 | 1 | 1 |
| Comparative Example 4 | 90.5 | 7.5 | 0 | 1 | 1 |

FIG. 2

| Item | Durability |
|---|---|
| Example 1 | Good |
| Example 2 | Good |
| Example 3 | Good |
| Comparative Example 1 | Some cracks |
| Comparative Example 2 | Some cracks |
| Comparative Example 3 | Good |
| Comparative Example 4 | Good |

| Item | Escherichia coli (Escherichia coli ATCC 8739) | | Staphylococcus aureus (Staphylococcus aureus ATCC 6538) | |
|---|---|---|---|---|
| | Initially (CUF/ml) | 18 hours later (CUF/ml) | Initially (CUF/ml) | 18 hours later (CUF/ml) |
| Example 1 | $2.5*10^5$ | 10 < | $2.6*10^5$ | 10 < |
| Example 2 | $2.5*10^5$ | 10 < | $2.6*10^5$ | 10 < |
| Example 3 | $2.5*10^5$ | 10 < | $2.6*10^5$ | 10 < |
| Comparative Example 1 | $2.5*10^5$ | 10 < | $2.6*10^5$ | 10 < |
| Comparative Example 2 | $2.5*10^5$ | 10 < | $2.6*10^5$ | 10 < |
| Comparative Example 3 | $2.5*10^5$ | 2.1*10 | $2.6*10^5$ | $4.5*10^5$ |
| Comparative Example 4 | $2.5*10^5$ | $2.1*10^5$ | $2.6*10^5$ | $2.7*10^5$ |

| | poly 2-way span | | |
|---|---|---|---|
| | pcm-aluminum | | |
| | 5% | 10% | 20% |
| Thermal conductivity(W/m.oC) A | 0.04634 | 0.04812 | 0.04882 |
| Instantaneous maximum flow rate(J/cm2.sec) A | 0.15 | 0.153 | 0.156 |
| | pcm-titanum | | |
| | 5% | 10% | 20% |
| Thermal conductivity(W/m.oC) T | 0.04717 | 0.04762 | 0.04907 |
| Instantaneous maximum flow rate(J/cm2.sec) T | 0.148 | 0.153 | 0.161 |
| | pcm-graphene | | |
| | 5% | 10% | 20% |
| Thermal conductivity(W/m.oC) G | 0.04672 | 0.04837 | 0.05133 |
| Instantaneous maximum flow rate(J/cm2.sec) G | 0.147 | 0.15 | 0.156 |

ARTIFICIAL TURF PILE YARN HAVING ANTIBACTERIAL AND COOLING EFFECT

BACKGROUND

The present invention relates to artificial turf constructed on a floor of a sports stadium and used as a substitute for natural turf, and specifically, it relates to artificial turf pile yarn that has an antibacterial effect to inhibit bacterial growth and a cooling effect at the same time.

DESCRIPTION OF THE RELATED ART

Artificial turf, made of synthetic fibers and shaped like grass, is an artificially produced substitute for turf. Since it was first produced in the United States in 1956, it has been mainly used in sports stadiums of for example, baseball, soccer, and golf. Such artificial turf has been constructed at places where natural turf may not be constructed, such as indoor gardens or dome stadiums where lighting is difficult, or places where growth of natural turf is difficult due to climatic and environmental reasons such as places where growth of natural turf is difficult due to concentrated trampling.

Although such artificial turf requires a high initial construction cost, it has many advantages that it can be used semi-permanently compared to natural grass, it has particularly high convenient for maintenance, it has an even surface suitable for exercise, it can always maintain a unique color, it is not limited by environmental conditions, and it is easy to maintain after construction. Thanks to the rapidly developing technologies, the preference for artificial turf has recently increased rapidly in various places regardless of the constructability of natural grass due to its excellent texture and excellent quality that are not inferior to those of natural turf.

However, when artificial turf is used as a replacement for natural turf, there is a problem that various bacteria and others proliferate as the period of use is extended. Efforts have been made to solve this problem, but it is not resolved yet.

In addition, in hot summer, artificial turf is not very efficient in dissipating or reflecting solar heat and it stores heat, and so people who exercise or engage in activities on artificial turf feel heat significantly. Especially when their skin comes into contact with artificial turf, they not only feel extreme heat but also discomfort, and severe friction and contact may cause even burns to the skin. Therefore, a countermeasure is required in this regard.

Not only will you feel extreme heat, but you will also feel uncomfortable, and severe friction and contact can even cause burns to your skin, so it is a reality that requires preparedness measures.

Patent Registration No. 10-2055556 (Dec. 9, 2019)

SUMMARY OF THE INVENTION

The problem that the present invention aims to solve is to provide an artificial turf pile yarn that has antibacterial properties to inhibit bacterial growth and is provided with a cooling function as well to resolve health concerns caused by bacteria and ensure pleasant and safe activities with a cooling sensation for people who perform activities and exercise on artificial turf.

The present invention to solve the problem described above is an antibacterial artificial turf pile yarn comprising 80 to 90% by weight of polyolefin resin, 3 to 10% by weight of a silicon-based compound, and 3 to 10% by weight of an antibacterial powder, wherein the antibacterial powder is copper sulfide powder, and the silicon-based compound and the antibacterial powder have a weight ratio of 1:5 to 5:1.

In addition, the antibacterial artificial turf pile yarn is coated to have a cooling function, and a PCM (phase change material) powder and titanium, aluminum, and graphene powders as a cooling material powder are prepared, wherein the PCM powder is mixed one or more powders of with titanium, aluminum, and graphene, and an eco-friendly acrylic binder is mixed as a binder to prepare a solution, and wherein the solution is supplied to a coater and an artificial turf pile yarn is transported so that an outer surface is coated with the solution.

The present invention may provide an antibacterial artificial turf pile yarn having an excellent antibacterial effect and durability by comprising a polyolefin resin, a silicon-based compound, and an antibacterial powder in a specific content; and an artificial turf structure comprising the same.

In addition, the present invention may provide an artificial turf that can allow users to perform activities while feeling pleasant and cool even in summer by mixing and coating PCM and materials such as titanium, aluminum, and graphene so that an artificial turf itself may exhibit a cooling effect.

BRIEF DESCRIPTION OF THE DRAWINGS

FIG. 1 is a table explaining configuration of an artificial turf pile yarn according to the present invention.

FIG. 2 is a table showing durability measurement of an artificial turf pile yarn according to Experimental Example 1 of the present invention.

DETAILED DESCRIPTION OF THE EMBODIMENTS

Figures 3, 4:
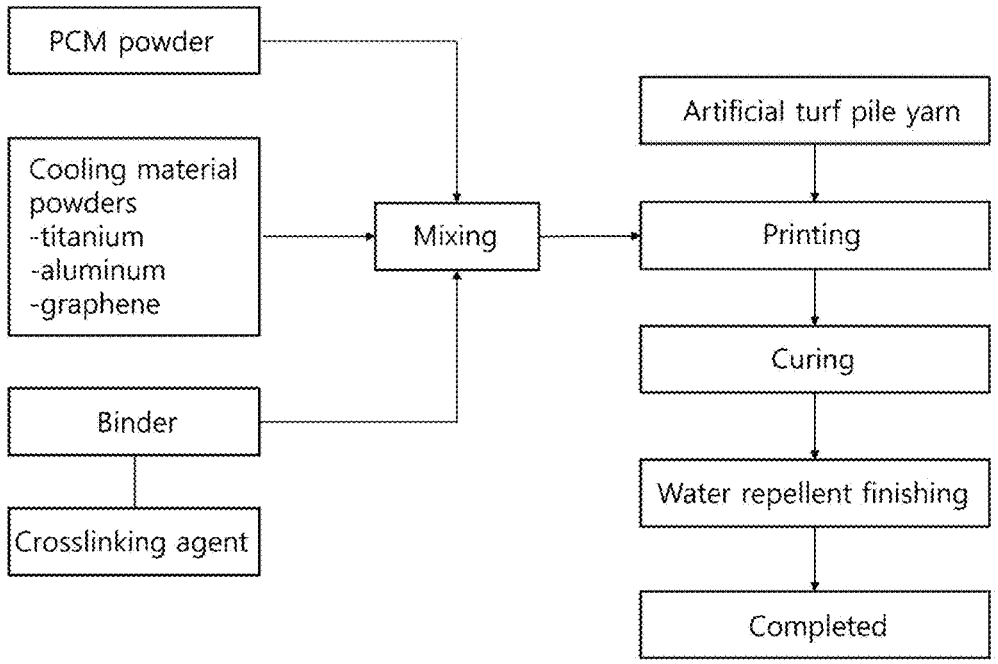
FIG. 3 is a table showing antibacterial effect measurement according to Experimental Example 2 of the present invention.
FIG. 4 is a diagram explaining a process for adding a cooling effect according to the present invention.
Figure 5:
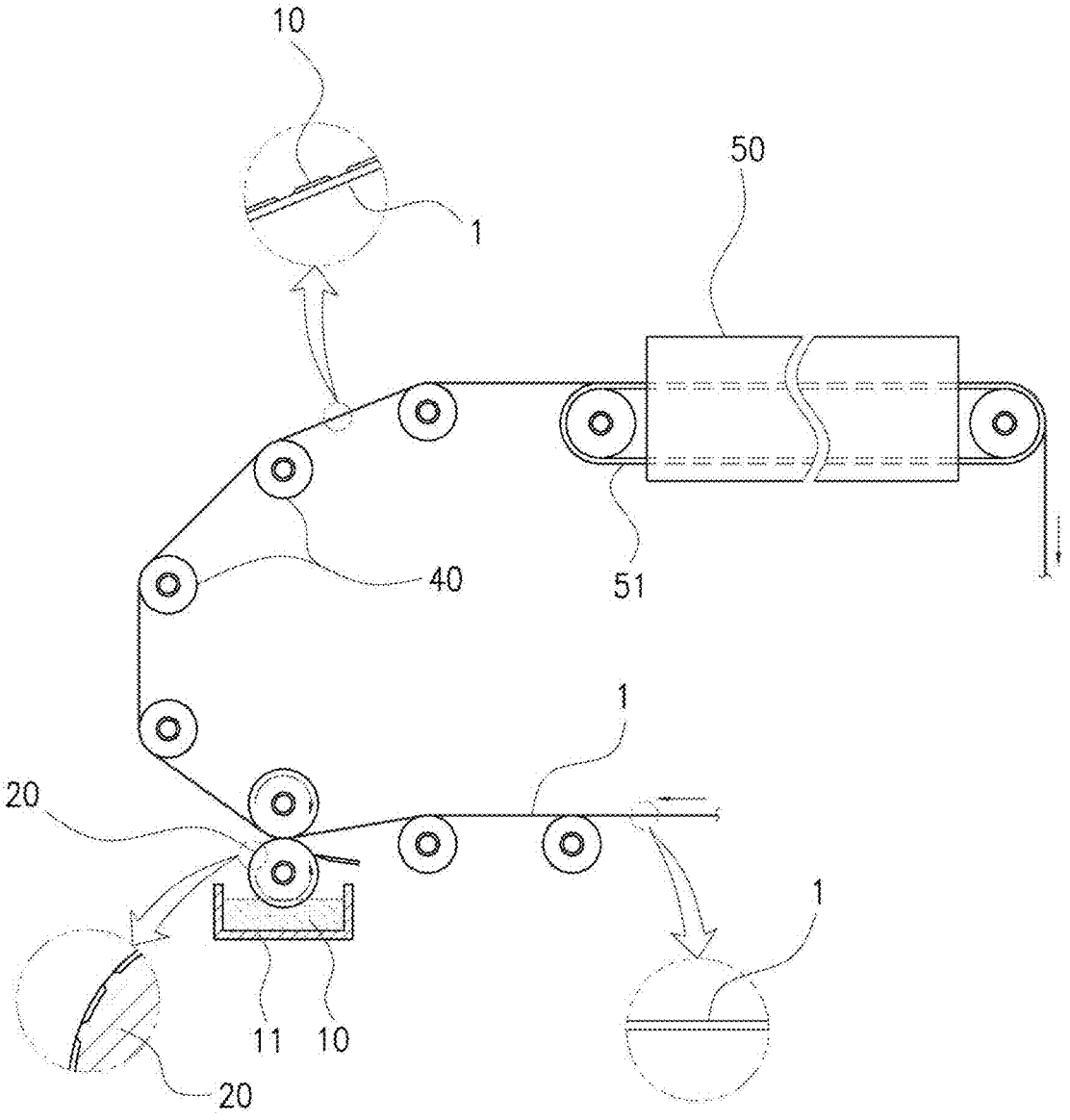
FIG. 5 is a diagram explaining a manufacturing device for adding a cooling effect according to the present invention.

Hereinafter, specific embodiments of the present invention will be described in more detail so that those skilled in the art may easily implement the present invention. However, the present invention may be embodied in many different forms and is not limited to the embodiments described herein.

The present invention relates to an antibacterial artificial turf pile yarn comprising 70 to 95% by weight of a polyolefin resin, 1 to 15% by weight of a silicon-based compound, and 1 to 15% by weight of an antibacterial powder.

In the present invention, the polyolefin resin is a polymer compound produced by polymerization of an olefin (a chain-shaped hydrocarbon compound having one double bond), and specifically comprises polyethylene, polypropylene, polyethylene-propylene copolymer, polyisobutylene, and the like.

The polyolefin resin may be one or more selected from the group consisting of linear low density polyethylene, low density polyethylene, medium density polyethylene, and high density polyethylene, and preferably, it may be linear low-density polyethylene.

The low density polyethylene may be a polyethylene having a melt index of 0.2 to 2.0 g/min and a density of 0.910 to 0.925 g/cm$^2$; the high density polyethylene may be a polyethylene having a melt index of 0.2 to 10 g/min and a density of 0.941 to 0.985 g/cm$^2$; the linear low density polyethylene may be a polyethylene having a melt index of 0.8 to 2.0 g/min a density of 0.915 to 0.930 g/cm$^2$; and the medium density polyethylene may be a polyethylene having a melt index of 0.5 to 1.5 g/min and a density of 0.935 to 0.970 g/cm$^2$.

The polyolefin resin is a base resin constituting a pile yarn, and the content is 70 to 95% by weight, preferably 80 to 90% by weight, based on 100% by weight of the antibacterial artificial turf pile yarn. When the content of the polyolefin resin is less than 70% by weight, durability may be reduced, and when it exceeds 95% by weight, the antibacterial effect may be reduced.

In the present invention, the silicon-based compound may be one or more selected from the group consisting of polydimethylsiloxane, polymethylalkylsiloxane, polydimethylsiloxane comprising a hydroxyl group, and siloxane, preferably polydimethylsiloxane (PDMS).

The silicon-based compound lacks a functional group that may re reacted and thus may provide stability and lubricity to the surface of a pile yarn. In addition, it is mixed with an antibacterial material and moves the antibacterial material to the surface instead of the inside of a pile yarn to maximize an antibacterial effect of the pile yarn.

The viscosity of the silicone-based compound may be 50 to 5,000 cst, and preferably, 100 to 1,000 cst. When the viscosity of the silicon-based compound is less than 50 cst, the durability of a pile yarn may be reduced, and when it exceeds 5,000 cst, the viscosity may be too high and thus industrial operability may be reduced, the quality of yarn may be reduced, and an antibacterial effect may be reduced as movement to the surface of a pile yarn becomes uneasy.

The viscosity of the silicone-based compound may be measured by using a Canon-Fenske type viscometer or the like by a dynamic viscosity measurement method, and the silicon-based compound may have a specific gravity of 0.950 to 1.000 at room temperature (25° C.).

The content of the silicon-based compound is 1 to 15% by weight, preferably 3 to 10% by weight, based on 100% by weight of the pile yarn. When the content of the silicon-based compound is less than 1% by weight, mixing with an antibacterial powder is not easy so that an antibacterial effect may be reduced, and when it exceeds 15% by weight, the durability of a pile yarn may be reduced and industrial operability may be reduced, and thus the quality of a yarn may be reduced.

In the present invention, the antibacterial powder is added to impart an antibacterial effect to the pile yarn, and may be copper sulfide or copper oxide or a mixed powder thereof, and preferably, a copper sulfide powder.

The copper sulfide or copper oxide powder may be prepared through a method known in the art. For example, it may be prepared as a powder through a process of wet milling, drying, dry milling, and sieving. It may impart to a pile yarn an excellent antibacterial effect in addition to conductivity, and it may inhibit growth of bacteria themselves and thus an excellent deodorizing effect may be acquired.

The copper (I) sulfide is also referred to as cuprous sulfide, and a chemical formula thereof is $Cu_2S$ and a formula weight thereof is 159.15. It may be obtained by heating copper with a hydrogen/hydrogen sulfide mixed gas or by heating copper (II) sulfide with a small amount of sulfur in hydrogen gas. Naturally, it is obtained from chalcocite.

Copper (II) sulfide is also referred to as cupric sulfide, and a chemical formula thereof is CuS and a formula weight thereof is 95.61.

In the present invention, the antibacterial powder may have a particle size of 0.1 to 3.5 μm, preferably 0.5 to 2.5 μm. When the particle size is less than 0.1 μm or more than 3.5 μm, the amount dispersed internally rather than on the surface of a pile yarn is increased during dispersion, and thus an antibacterial effect may be reduced.

In addition, the content of the antibacterial powder is 1 to 15% by weight, preferably 3 to 10% by weight, based on 100% by weight of the pile yarn. When the content of the antibacterial powder is less than 1% by weight, an antibacterial effect may be negligible, and when it exceeds 15% by weight, improvement of an antibacterial effect may be negligible compared to the manufacturing cost, and agglomeration of powder may clog a nozzle, thereby reducing spinnability and durability.

In the present invention, the silicon-based compound and the antibacterial powder may have a weight ratio of 0.1:1 to 10:1, and preferably 1:5 to 5:1. When the weight ratio is less than 0.1 to 10, the content of the silicon-based compound is low so that mobility to a surface may be reduced and an antibacterial effect may be reduced, and when it exceeds 10:1, the content of the antibacterial powder is low so that an antibacterial effect may be reduced.

In the present invention, the pile yarn may further comprise one or more selected from the group consisting of a compatibilizer, an anti-aging agent, an antioxidant, a color masterbatch, and a flame retardant, which may be included in 0.1 to 10% by weight, preferably 0.5 to 5% by weight, based on 100% by weight of the pile yarn. The types of the compatibilizer, anti-aging agent, antioxidant, color masterbatch, and flame retardant are not particularly limited, and common ones may be used.

The antibacterial artificial turf pile yarn according to the present invention may be manufactured by forming a master batch of 70 to 95% by weight of a polyolefin resin, 1 to 15% by weight of a silicone compound, and 1 to 15% by weight of an antibacterial powder and adding the same to a spinning machine to perform melt spinning.

Hereinafter, specific embodiments according to the present invention will be described.

Example 1

A master batch was formed with 83% by weight of linear low density polyethylene (LLDPE), 7.5% by weight of polydimethylsiloxane (PDMS) with a viscosity of 500 cst, and 7.5% by weight of copper sulfide powder with a particle size of 0.5 μm and placed in a spinning machine. Then, 1% by weight of a green masterbatch and 1% by weight of maleic acid anhydride were added and mixed in a spinning machine, and melt spinning was performed to manufacture an antibacterial artificial turf pile yarn.

Example 2

An antibacterial artificial turf pile yarn was manufactured by the same method as in Example 1, except that 85% by weight of linear low density polyethylene (LLDPE), 3% by weight of polydimethylsiloxane (PDMS), and 10% by weight of copper sulfide powder were added.

Example 3

An antibacterial artificial turf pile yarn was manufactured by the same method as in Example 1, except that 85% by weight of linear low density polyethylene (LLDPE), 10% by weight of polydimethylsiloxane (PDMS), and 3% by weight of copper sulfide powder were added.

Comparative Example 1

An antibacterial artificial turf pile yarn was manufactured by the same method as in Example 1, except that 75% by weight of linear low density polyethylene (LLDPE), 3% by weight of polydimethylsiloxane (PDMS), and 20% by weight of copper sulfide powder were added.

Comparative Example 2

An antibacterial artificial turf pile yarn was manufactured by the same method as in Example 1, except that 75% by weight of linear low density polyethylene (LLDPE), 20% by weight of polydimethylsiloxane (PDMS), and 3% by weight of copper sulfide powder were added.

Comparative Example 3

A master batch was formed with 90.5% by weight of linear low density polyethylene (LLDPE) and 7.5% by weight of copper sulfide powder with a particle size of 0.5 μm and placed in a spinning machine. Then, 1% by weight of a green masterbatch and 1% by weight of maleic acid anhydride were added and mixed in a spinning machine, and melt spinning was performed to manufacture an antibacterial artificial turf pile yarn.

Comparative Example 4

A master batch was formed with 90.5% by weight of linear low density polyethylene (LLDPE) and 7.5% by weight of polydimethylsiloxane (PDMS) with a viscosity of 500 cst and placed in a spinning machine. Then, 1% by weight of a green masterbatch and 1% by weight of maleic acid anhydride were added and mixed in a spinning machine, and melt spinning was performed to manufacture an antibacterial artificial turf pile yarn.

FIG. 1 is a table showing configuration of the artificial turf pile yarns manufactured in Examples 1 to 3 and Comparative Example 1 to 4.

Experimental Example 1

The durability and spinnability of the pile yarns manufactured in Examples 1 to 3 and Comparative Examples 1 to 4 were measured according to the measurement methods described below, and the results are shown in the table of FIG. 2.

Measurement Method

Durability: After abrading each artificial turf system 30,000 times by using LISPORT stud abrasion equipment, the state of an outer appearance of a pile yarn was observed.

Referring to the table of FIG. 2, when PDMS or a copper sulfide powder was included in 1 to 15% by weight (Examples 1 to 3, Comparative Examples 3 and 4), durability was excellent, but when it was out of the range (Comparative Examples 1 and 2), it was confirmed that durability was reduced and some cracks were generated.

Experimental Example 2

To confirm an antibacterial effect of the pile yarns manufactured in Examples 1 to 3 and Comparative Examples 1 to 4, measurement was performed by using the method described below, and the results are shown in the table of FIG. 3.

Measurement Method

An aqueous solution containing *E. coli* and *Staphylococcus aureus* was applied to 100 g of the pile yarns manufactured in Examples 1 to 3 and Comparative Examples 1 to 4, dried, and subjected to measurement according to a test method of KS K 0693:2001, which is an antibacterial test.

Referring to the table of FIG. 3, when a copper sulfide powder was added (Examples 1 to 3 and Comparative Examples 1 to 3), the antibacterial effect was very high compared to the case where a copper sulfide powder was not added (Comparative Example 4).

In addition, when comparing the case where PDMS was added (Example 1) and the case where PDMS was not added (Comparative Example 3), although the content of copper sulfide powder was the same, the antibacterial effect was very high in the case where PDMS was added (Example 1).

The present invention is manufactured to have antibacterial properties as described above, and then a cooling feature is provided by carrying out the following procedure to have cooling properties.

A PCM (phase change material) powder is prepared so that the particle size of the powder may be 20 to 30 μm, and titanium, aluminum, and graphene powders are prepared so that the particle size of the powders may be 20 to 30 μm. After that, the three cooling powders may be used by mixing each with a binder or by mixing two or more powders, considering the advantages and disadvantages of each ingredient.

An eco-friendly acrylic binder is prepared as a binder to mix the PCM powder, titanium, aluminum, and graphene powder to have an appropriate viscosity and to be coated on the artificial turf pile yarn for proper adhesion. The reason why an acrylic binder is selected in the present invention because the present invention targets artificial turf pile yarns having elasticity and so an elastic acrylic binder should be selected as a binder to maintain adhesion well during and after coating in response to stretching of artificial turf pile yarns.

In addition, to increase fastness, an eco-friendly non-formalin type crosslinking agent (blocked-isocyanate; medium-temperature dissociation type) is mixed at a ratio of 3 to 5% based on the binder weight.

The prepared ingredients are mixed at ratios described below.

First, a binder comprising the eco-friendly non-formalin type crosslinking agent is prepared at 70% (all ratios hereinafter are in weight ratios), and PCM is mixed thereto at 30% to prepare a 100% base. The ratios of 70% and 30% above may be adjusted within a range of ±10% each to obtain similar effects without departing from the gist of the invention.

A solution was completed by mixing a cooling powder with the base at 20% of the weight of the base. In the present invention, find out an optimal mixing ratio of a cooling powder (titanium, aluminum, and graphene), 5%, 10%, and 20% were each mixed and tested.

As a specific example, a cooling powder was each mixed at 5% (20 g), 10% (40 g), and 20% (80 g) with 400 g of the base to prepare solutions with different mixing ratios.

The solution is supplied to a coating machine through which an artificial turf pile yarn is passed so that an outer surface of the artificial turf pile yarn is coated with the solution.

After the coating process, an artificial turf pile yarn passes through a curing chamber 50 through several guide rollers 40. A heater to apply heat is installed inside a curing chamber 50, and a net conveyor 51 in the form of a mesh network is installed so that in process of passing through a curing chamber 50, an artificial turf pile yarn 1 may pass in a tension-free state without applying a tension thereto in order that the artificial turf pile yarn may neither lose elasticity nor be deformed.

After coating an artificial turf pile yarn, water-repellent finishing should be performed. Water-repellent finishing is necessary to prevent quick water permeation or contamination and penetration of foreign substances.

A coating was applied to an artificial turf pile yarn manufactured in the manner described above, and an experiment was performed about cooling performance. Experiments were performed by using three ingredients, which were aluminum, titanium, and graphene, and the results shown in the table of FIG. 7 were obtained.

Figures 6, 7:
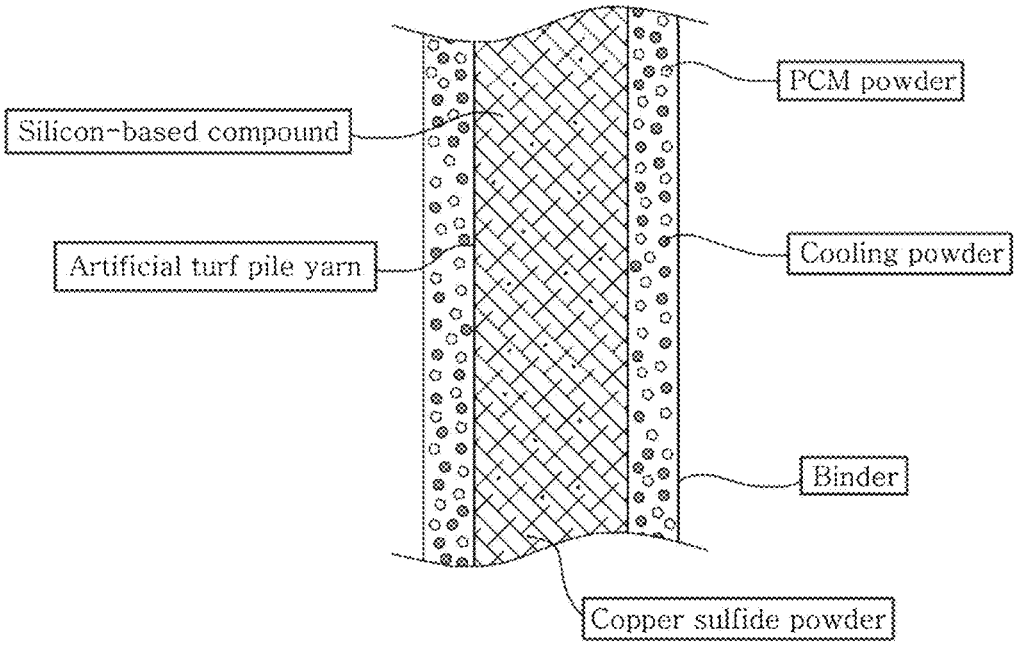
FIG. 6 is an exemplary diagram of a magnified cross-section of an artificial turf pile yarn according to the present invention.
FIG. 7 is an experimental chart showing cooling performance of an artificial turf pile yarn according to the present invention.

As shown in the table of FIG. 7, thermal conductivity is the best when 20% of graphene is used as a cooling material, and an instantaneous maximum flow rate is the best when 20% of titanium is used as a cooling material.

According to the example described above, in addition to a cooling effect achieved by an existing PCM method, a cooling effect was further increased by comprising a powder, such as titanium, having cold properties. A maximum effect was obtained by comprising titanium, aluminum, and graphene powders of appropriate ratios and mixing PCM powder, titanium, aluminum, and graphene powders, and a binder at appropriate ratios.

In the present invention, a process described below may be added to enhance an antibacterial effect.

A capsule of nanoparticles comprising copper sulfide or copper oxide or a mixed powder thereof may be configured and the capsule of nanoparticles may be added to a solution in the coating process for imparting a cooling sensation so that in the coating process, the capsule of nanoparticles, together with the solution having a cooling effect, may be coated on an outer surface of an artificial turf pile yarn.

Through addition of this process, when an artificial turf pile yarn is used as an artificial turf, when a user's body or an exercise tool comes into contact with or gives an impact to the artificial turf pile yarn, the capsule of nanoparticles may be destroyed and thus an antibacterial ingredient may be released, resulting in long-term expression and maintenance of a uniform antibacterial effect.

REFERENCE NUMERALS

1: artificial turf pile yarn
10: solution
11: supply tank
20: coating roller

What is claimed is:

1. An artificial turf pile yarn having antibacterial and cooling effects, comprising 80 to 90% by weight of polyolefin resin, 3 to 10% by weight of a silicon-based compound, and 3 to 10% by weight of an antibacterial powder, wherein the antibacterial powder is copper sulfide powder, and the silicon-based compound and the antibacterial powder have a weight ratio of 1:5 to 5:1, wherein the antibacterial artificial turf pile yarn is coated to have a cooling function, and a PCM (phase change material) powder is prepared so that the particle size of the PCM powder is 20 to 30 μm, and titanium, aluminum, and graphene powders are prepared so that the particle size of the titanium, aluminum, and graphene powders is 20 to 30 μm, wherein one or more of the titanium, aluminum, and graphene powders are mixed with the PCM powder, wherein an eco-friendly acrylic binder is prepared to be coated on the artificial turf pile yarn for adhesion, wherein the eco-friendly acrylic binder is mixed with the PCM powder and the one or more of the titanium, aluminum, and graphene powders to prepare a solution and the solution is supplied to a coating machine and the artificial turf pile yarn is transported to coat with the solution, wherein a master batch is formed with the polyolefin resin, the silicon-based compound, and the antibacterial powder, wherein the master batch is formed with a viscosity of the silicone-based compound being 50 to 5,000 cst.

2. The artificial turf pile yarn having antibacterial and cooling effects according to claim 1, wherein the polyolefin resin is one or more selected from the group consisting of linear low density polyethylene, low density polyethylene, medium density polyethylene, and high density polyethylene.

3. The artificial turf pile yarn having antibacterial and cooling effects according to claim 1, wherein the silicon-based compound is one or more selected from the group consisting of polydimethylsiloxane, polymethylalkylsiloxane, polydimethylsiloxane comprising a hydroxyl group, and siloxane.

4. The artificial turf pile yarn having antibacterial and cooling effects according to claim 1, wherein the antibacterial powder has a particle size of 0.1 to 3.5 μm.

5. The artificial turf pile yarn having antibacterial and cooling effects according to claim 1, wherein the antibacterial artificial turf pile yarn further comprises one or more selected from the group consisting of a compatibilizer, an anti-aging agent, an antioxidant, a color masterbatch, and a flame retardant.

6. The artificial turf pile yarn having antibacterial and cooling effects according to claim 1, wherein the PCM powder and the eco-friendly acrylic binder have a weight ratio of 30%:70%±10%.

7. The artificial turf pile yarn having antibacterial and cooling effects according to claim 1, further comprising a capsule of nanoparticles comprising copper sulfide or copper oxide or a mixed powder, wherein the capsule of nanoparticles is added to the solution supplied to the coating machine for imparting a cooling sensation so that the capsule of nanoparticles is coated on an outer surface of the artificial turf pile yarn.

8. The artificial turf pile yarn having antibacterial and cooling effects according to claim 1, wherein the eco-friendly acrylic binder comprises an eco-friendly non-formalin type crosslinking mixed at a ratio of 3 to 5% based on the eco-friendly acrylic binder weight.

9. The artificial turf pile yarn having antibacterial and cooling effects according to claim 8, wherein the eco-friendly non-formalin type crosslinking agent is a blocked-isocyanate.

10. The artificial turf pile yarn having antibacterial and cooling effects according to claim 1, wherein the antibacterial powder has a particle size of 0.5 to 2.5 μm.

11. The artificial turf pile yarn having antibacterial and cooling effects according to claim 1, wherein the polyolefin resin is a linear low-density polyethylene.

12. The artificial turf pile yarn having antibacterial and cooling effects according to claim 10, wherein a linear low density polyethylene is a polyethylene having a melt index of 0.8 to 2.0 g/min and a density of 0.915 to 0.930 g/cm$^3$.

13. The artificial turf pile yarn having antibacterial and cooling effects according to claim 1, wherein the silicon-based compound is polydimethylsiloxane.

14. The artificial turf pile yarn having antibacterial and cooling effects according to claim 1, wherein the antibacterial powder has a particle size of 0.1 to 3.5 μm, wherein the PCM powder and the eco-friendly acrylic binder have a weight ratio of 30%:70%±10%.

15. The artificial turf pile yarn having antibacterial and cooling effects according to claim 14, wherein the antibacterial artificial turf pile yarn further comprises one or more selected from the group consisting of a compatibilizer, an anti-aging agent, an antioxidant, a color masterbatch, and a flame retardant.

* * * * *